United States Patent [19]

Chmiel

[11] 4,107,937

[45] Aug. 22, 1978

[54] METHOD OF AND APPARATUS FOR THE DEEP FREEZING OF BIOLOGICAL SUBSTANCES

[75] Inventor: Horst Chmiel, Leonberg, Germany

[73] Assignee: Linde Aktiengesellschaft, Wiesbaden, Germany

[21] Appl. No.: 752,930

[22] Filed: Dec. 21, 1976

[30] Foreign Application Priority Data

Dec. 22, 1975 [DE] Fed. Rep. of Germany ..... 2557870

[51] Int. Cl.[2] ..... F25D 17/02

[52] U.S. Cl. ..... 62/64; 62/78; 62/373; 165/30; 195/1.8

[58] Field of Search ..... 62/64, 78, 373; 195/1.8; 165/30

[56] References Cited

U.S. PATENT DOCUMENTS

| | | | |
|---|---|---|---|
| 2,508,988 | 5/1950 | Bradley | 165/30 |
| 2,662,520 | 12/1953 | McMahon | 62/64 |
| 3,167,812 | 2/1965 | Von Bennigsen | 165/30 |
| 3,753,357 | 8/1973 | Schwartz | 62/64 |
| 3,940,943 | 3/1976 | Sikes et al. | 62/64 |
| 4,033,737 | 7/1977 | Kunioka et al. | 62/64 |

*Primary Examiner*—Ronald C. Capossela
*Attorney, Agent, or Firm*—Karl F. Ross

[57] ABSTRACT

A system for the deep freezing of biological substances provides an input representing the temperature-time curve required at the outer wall of a receptacle containing biological substances to be deep-frozen while a sensor measures the actual temperatures at this wall and controls the cooling applied to the receptacle to conform the cooling at the receptable wall to the precalculated temperature-time curve. This permits the necessary temperature gradient to be applied to the biological substance for maximum cell survival without any dead time necessitated by the use of sensors within the biological substance itself.

11 Claims, 5 Drawing Figures

-7
-196
TEMPERATURE T (°C)
$T_i$ CALCULATED
$T_a$ MEASURED
0
1.0
2.0
COOL DOWN TIME t (min)

VARIATION IN TEMPERATURE WITH DISTANCE X IN THE FROZEN SUSPENSION WITH TIME-DEPENDENT WALL TEMPERATURE $T_i$

METHOD OF AND APPARATUS FOR THE DEEP FREEZING OF BIOLOGICAL SUBSTANCES

FIELD OF THE INVENTION

The present invention relates to a method of and to an apparatus for the deep-freezing of biological substances in respective receptacles and, more particularly, to the deep-freezing of biological substances which have been introduced into so-called bioreceptacles and are sealed therein prior to being deep-frozen by means of a coolant or refrigerant such as liquefied nitrogen.

BACKGROUND OF THE INVENTION

In cryogenic processes for the preservation of biological substances such as blood, blood components, cell suspensions and cell tissues, the major problem resides in avoiding irreversible cell damage which can result during the freezing process and the subsequent thawing process, or the minimizing of such damage.

It has been proposed heretofore to limit the cell damage of biological substances of the character described by the addition of a cryophylactic protective additive or agent which serves to protect the cells against the effects of freezing and thawing and which is mixed with the cell suspension or other biological substance. Such protective agents increase the survival rate of the frozen cell materials.

Protective additives such as glycerin have been used heretofore, especially for the protection of blood against the effects of the deep-freezing process, and must be washed from the preserved biological substances after thawing because they can adversely affect the human organism. Considerable research has gone into the development of biologically innocuous protective additives and, when such are employed, the survival rate can be increased.

Investigations have shown that an important factor in avoiding the decomposition or destruction of the cells is the temperature gradient with which the cells are frozen. In other words, there are predeterminable cell-specific time-dependent temperature gradients at which cellular material, i.e., the biological substances described above, can be frozen to obtain a survival rate of about 98%. This latter percentage has been found to be a reasonable level for most cryogenic deep-freezing processes and, when reference is made herein to time-dependent cell-specific temperature gradients, it will be understood that such gradients are intended as will ensure a cell survival rate of about 98% following deep-freezing and thawing.

When the speed of the freezing process lies beneath this temperature gradient, the concentration of the extracellular liquid is increased during the freezing process by the freezing out of water therefrom. This results in an increase in the osmotic pressure between the inner-cell and outer-cell media. Furthermore, during the freezing process water is withdrawn from the cells themselves and this results in a concentration increase in the intracellular solution as well. This can give rise to denaturation of the proteins in the cell interiors. While the effects of such processes can be minimized by an increase in the speed of the freezing process, there nevertheless is a tendency at both excessively high speeds and low speeds to produce intercellular ice which, in any case, breaks down the cell walls and membranes.

Of course, the amount and type of protective agent will also influence the desired temperature gradient of the freezing process. For example, when mixtures of erythrocytes with glycerin in high concentrations of about 50% are subjected to deep-freezing at a temperature gradient of about 8 K/min (8° Kelvin or Centigrade per minute), high survival rates of the blood cells are noted. For unprotected erythrocytes, the optimum temperature gradient is about 5000 K/min and even at this optimum, the maximum survival rate of the cells is found to be only about 60%.

Known processes for the deep-cooling preservation of biological substances, which can be contained in so-called bioreceptacles, either maintain the biological receptacle in a liquid nitrogen bath for a predetermined time period, sometimes with shaking in order to ensure effective mixture of the biological substance with the protective agent, or spray the bioreceptacle with liquid nitrogen while monitoring the temperature within the interior of the receptacle.

The receptacle which can be used in the prior-art systems and in the invention described below can be any synthetic-resin sac or other container conventionally used to receive mixtures of blood and protective agents or other biological substances admixed with protective agents.

By the technique described above, the freezing process cannot be accurately maintained at a predetermined cell-specific temperature gradient.

The immersion process, which can be limited only as to time, does not permit variation in the temperature gradient under such controls as to maintain a predetermined cell-specific temperature gradient and the optimum temperature gradient for any specific cell can, at best, only be approached.

The spray process permits a monitoring of the change of temperature with time by means of a thermoelement in the interior of the bioreceptacle, but has the disadvantage that there is a large time lag in the control process, i.e., the reaction time between a change in the supply of the coolant and the resulting change in the temperature in the interior of the bioreceptacle is considerable. This, too, prevents an accurate control of the temperature gradient.

OBJECTS OF THE INVENTION

It is the principal object of the present invention to provide a process and an apparatus for the deep-freezing of biological substances contained in bioreceptacles, in which during the freezing process a cell-specific temperature gradient optimum for the specific biological substance can be maintained with high precision and high reproducibility.

It is another object of the invention to provide a system for the deep-freezing of biological substances, such as those mentioned above, with or without protective agents, whereby the aforementioned disadvantages are avoided.

SUMMARY OF THE INVENTION

These objects are attained, in accordance with the present invention, in a system (process and/or apparatus) whereby the temperature of the outer wall of the bioreceptacle is controlled as a function of time to conform to the temperature-time curve which is calculated to correspond to the optimum temperature gradient for any specific biological substance at the outer wall of the bioreceptacle.

In other words, according to the invention, when a predetermined temperature gradient is to be maintained during the freezing process to ensure approximately 98% survival rate of the cells of this biological substance upon deep-freezing, the temperature-time curve at the outer wall of the bioreceptacle necessary to maintain this predetermined temperature gradient is first calculated and the deep-freezing process is controlled so that the temperature at the outer wall of the bioreceptacle varies as a function of time to correspond to this calculated temperature-time curve.

By precalculating the temperature-time curve for the outer wall of the bioreceptacle, which yields the desired temperature gradient for the biological substance in the interior of the bioreceptacle, and by conforming the change in temperature at the outer wall of the bioreceptacle with time to correspond to this calculated temperature-time curve, it is possible in accordance with the invention to carry out the freezing process of any given biological substance with the desired temperature gradient without concern for dead time, thermal inertia or lag time in a control process.

An important characteristic of the invention is that it permits a thermoelement in the interior of the bioreceptacle to be completely dispensed with and it also eliminates the effects of long reaction times resulting from delays in the change in the temperature within the bioreceptacle.

Because of the mathematical solution which is used to calculate the temperature within the bioreceptacle, all measurements of the temperature within the interior of the biological substance in the bioreceptacle can be eliminated. The calculation, of course, takes into consideration the thickness of the wall of the bioreceptacle, the coefficient of thermal conduction thereof, its heat capacity and the heat-transfer coefficient between the cooling fluid and the receptacle wall and between the receptacle wall and the biological substances as well as the thermal characteristics of the liquid layers and the interfacial thermal characteristics between the receptacle and the fluids.

According to one aspect of the invention, the freezing process is controlled to correspond to the calculated temperature-time curve when the bioreceptacle is sprayed with a liquefied coolant, especially nitrogen, and the supply of the cooling medium per unit time is regulated in dependence upon the temperature measured at the outer wall of the bioreceptacle. A lag in control, of the type which occurs when the measurement of the temperature takes place in the interior of the receptacle, is excluded. The desired temperature gradient can be accurately maintained.

According to another aspect or feature of the invention, the bioreceptacle can be electrically heated externally during the freezing process so that the desired change in temperature with time is maintained at the outer wall of the bioreceptacle which is subjected to deep-freeze cooling by, for example, the spray-cooling technique mentioned above or by immersion cooling. Of course, in this case, the heat abstracted by the coolant must exceed the heat delivered by the electrical heating means. It has been found that the electrical heating technique permits a highly exact control of the temperature on the external surface of the receptacle and hence maintains a predetermined temperature gradient.

It has been found to be highly advantageous, in the deep-freezing of cells and biological substances which require relatively low temperature gradients of few °K/min, to avoid cell damage, for example for the freezing of corpuscular blood components such as thrombocytes or lymphocytes, to provide the freezing apparatus with a pair of plates of low thermal conductivity and to dispose the bioreceptacle between these plates. These plates can be composed of synthetic resin and have wall thicknesses which are calculated, in dependence upon the temperature-time curve for the outer wall of the receptacle, to provide the desired temperature as a function of time at this outer wall. The assembly of the low-thermal-conductivity plates and the bioreceptacle can then be immersed in a liquefied gas, e.g. liquefied nitrogen, forming the coolant bath.

The bioreceptacle can also be heated, preferably electrically, along its external surface even in the immersion, to maintain the temperature function of time at the external surface of the receptacle in conformity with the calculated temperature-time curve.

In this case, the desired temperature gradient can be provided as a first approximation by the control of the wall thickness of the plates of low-thermal-conductivity material and can be corrected by heating the outer wall of the bioreceptacle in response to an actual measurement of the temperature at this wall, the measured temperature being compared with the calculated temperature at any instant in time of the temperature-time curve to produce an error signal which controls the heating.

The low-heat-conductivity plates thus provide a coarse control of the freezing speed while the heating operation maintains the fine control thereof.

An apparatus for carrying out the process of the present invention, using the spray-cooling technique, advantageously comprises a cooling channel disposed in a sterile chamber and provided with feed means for supplying the liquefied coolant and a control or regulating unit (controller) such that the liquefied coolant spray device is connected to the source of liquefied coolant while the latter is connected, in turn, to the controller.

Advantageously, the cooling channel can be disposed vertically and can be provided, along its opposite flanks, with copper pipes whose nozzles are trained toward one another and against the bioreceptacle which is introduced between the copper pipes so that the liquefied coolant is sprayed directly onto the surface of the bioreceptacle.

It is especially advantageous, in accordance with the invention, to provide a thermal element (temperature sensor) within the cooling channel such that it lies in direct contact with the outer surface of the bioreceptacle and is connected to the controller for operating same.

Based upon the geometry and materials of the receptacle and of the cooling channel, the temperature-time curve for the outer wall of the bioreceptacle, based upon the desired temperature gradient of the biological substance therein, can be readily calculated and can serve as a set point value for the controller, being compared, at any instant, with the measured temperature to produce a signal which is employed to control the supply device for the liquefied coolant.

This not only has the advantage that it can carry out the deep-freexing under fully sterile conditions, without contact of the biological substance with the temperature sensor or any extraneous element, but also avoids the problem of thermal inertia or dead time in the control process.

According to another feature of the invention, a holder for the bioreceptacle is provided within the cooling channel between the spray systems and is adapted to receive the bioreceptacle such that the latter lies in contact with the surfaces of the holder. A surface of the holder in contact with the bioreceptacle can be provided with a temperature-sensing element described above while the outer surface of the holder plates can be provided with electrical heating devices for the purposes described previously.

The holder plates can be sheet metal elements contoured to receive the receptacle and can be urged against the latter by spring and/or lever devices which can be used to spread the plates when the receptacle is received and to firmly hold the plates in surface-to-surface contact with the outer walls of the receptacle when the latter is subjected to deep-freezing.

The heating means can be electrical heating coils embedded in silicone rubber and applied to the external surfaces of the plates. The amount of heating generated per unit area and the amount of cooling applied by the spray nozzles per unit area of the plates can be regulated by the controller in accordance with the temperature measured at the outer wall of the bioreceptacle.

The supply device for the coolant can, according to still another feature of the invention, include, besides the vessel containing the liquefied coolant, also a vessel for the gaseous cooling medium such that the liquefied-coolant vessel is connected to the gaseous-coolant vessel through the controller. The interior of the liquefied-coolant receptacle can thus be maintained at a constant superatmospheric pressure.

When, before the liquefied coolant is withdrawn, the liquid level falls below a predetermined height in the liquefied-coolant receptacle, the controller is triggered by the pressure drop and feeds gaseous medium from the other receptacle into the liquefied-coolant receptacle to maintain the necessary superatmospheric pressure therein.

An apparatus for carrying out the process according to the immersion technique comprises a container for the liquefied coolant, an immersion device and, advantageously, a holder which is suspended from the immersion device and which includes a pair of plates of low-thermal-conductivity material between which the bioreceptacle can be disposed. The apparatus also includes a controller which responds to a thermal element in contact with the outer wall of the bioreceptacle and a heating device operated by the controller. The thermal element or temperature sensor is thus preferably mounted on the inner surface of a metal plate between two of which the bioreceptacle is received.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
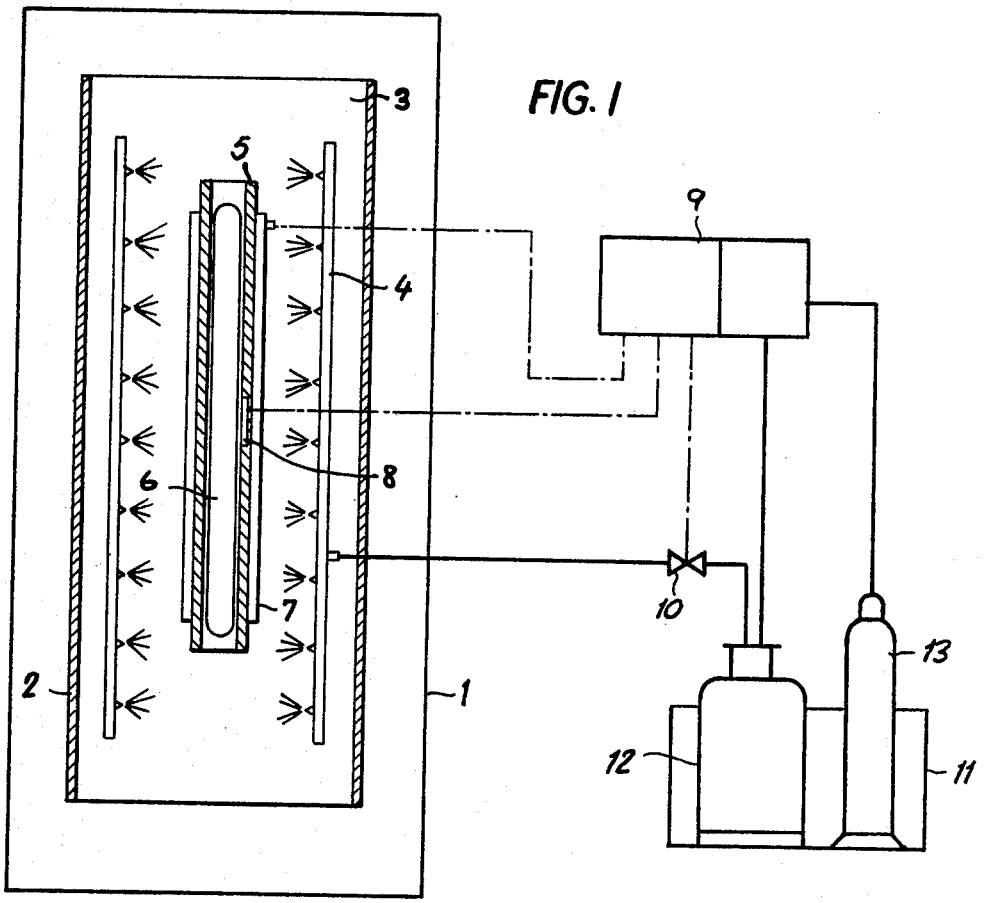
FIG. 1 is a vertical section through a deep-freezing chamber according to the invention, shown in diagrammatic form, and illustrating other portions of the apparatus according to one embodiment of the invention schematically.
Figure 2:
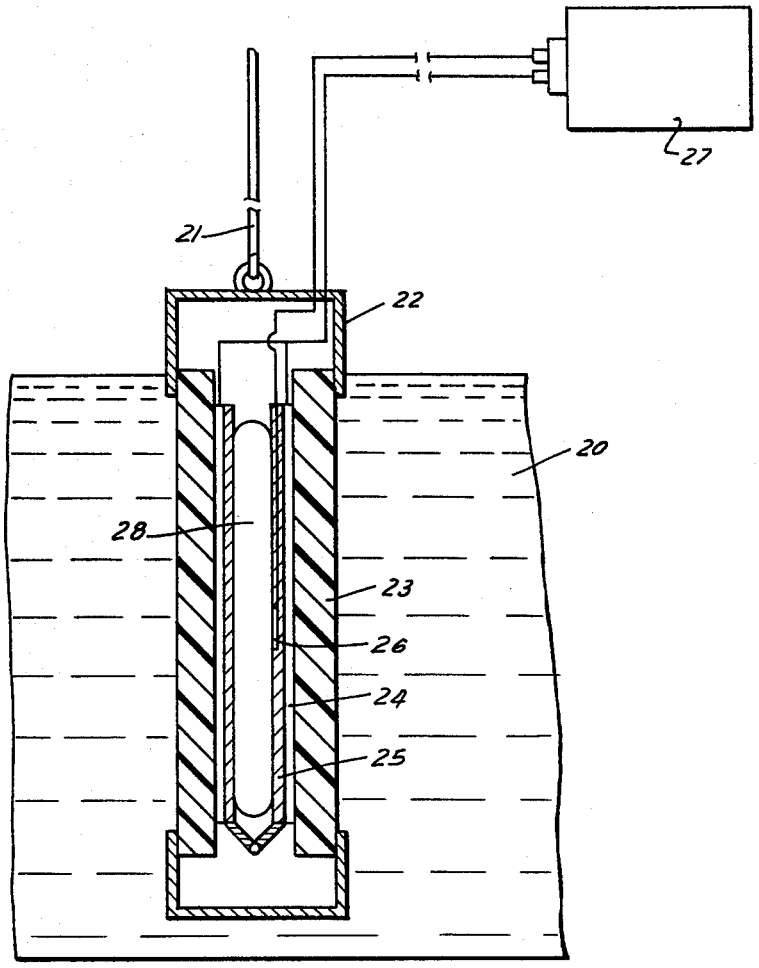
FIG. 2 is a view similar to FIG. 1 but illustrating another embodiment of the invention.

The embodiment of FIG. 1 uses the spray technique for the deep-freezing of biological substances of the type described while the embodiment of FIG. 2 utilizes the immersion technique. Both embodiments can make use of a controller of the type shown in FIG. 3. Throughout this specification, when references is made to biological substances, it is intended to include therein blood, blood components, cell suspensions and cell tissues which may or may not be admixed with protective agents. When it is desired to use such protective agents, however, it is preferred that they be admixed with the biological substances by the method and apparatus described in the concurrently filed copending application Ser. No. 752,836 filed Dec. 21, 1976, in which there is described such mixing. This application is included herein in its entirety by reference.

In FIG. 1, the sterile hermetically sealed chamber 1 is provided with a deep-freezing device 2 including a vertical cooling channel 3 having along its opposite interior walls a spray system 4 for a liquefied coolant, e.g. nitrogen. The spray system can comprise vertical copper pipes having nozzles which train the sprays of liquid nitrogen against the bioreceptacle 6 containing the biological substance, preferably in admixture with the protective agent, and packed and sealed as described in the aforementioned application.

Between the spray nozzles, there is provided a holder 5 for the bioreceptacle 6, the holder having external contours conforming to those of the bioreceptacle and preferably being clamped thereagainst by spring or lever means not shown. The plates of the holder can be of sheet metal and are provided along their external surfaces, i.e., their surfaces turned away from the bioreceptacle, with heating coils 7 embedded in layers of silicone rubber. These heating coils permit the heating of the bioreceptacle 6.

On the surface of the holder 5 contacting the outer wall of the bioreceptacle 6, there is provided a temperature-sensing element 8 which preferably bears against the bioreceptacle to ensure a firm contact therewith. This temperature sensor measures the temperature on the exterior wall of the biorecptacle 6 and is connected to a controller 9 through which the heating coils 7 are energized and which also operates a valve 10 supplying the nozzle systems 4 with the liquefied coolant (liquid nitrogen) from a supply device 11.

Thus the moment of liquefied coolant supplied per unit time and the heating via coils 7 per unit time are regulated by the controller 9 in response to the thermo element 8 to provide a temperature at the outer wall of the receptacle 6 which is a function of time and conforms to the precalculated temperature-time curve described above.

In order to ensure a constant flow of the liquefied coolant via the valve 10 to the nozzles 4, the supply unit 11 is provided with a receptacle 12 for the liquefied coolant and means connecting this receptacle 12 through the controller 9 to a bottle 13 supplying the gaseous coolant at an adjustable superatmospheric pressure. Should the pressure fall in the line feeding the nozzles 4, gas is fed from bottle 13 to the receptacle 12.

FIG. 2 shows an immersion deep-freezing system in which a container 20 has a bath of the liquefied coolant and is provided at 21 with an immersion device for lowering the bioreceptacle into this bath.

According to the invention, this immersion device 20 is designed to control the depth to which the receptacle is lowered into the bath. The immersion device 21 carries a holder 22 in which the bioreceptacle 28 can be received, the holder 22 being suspended from this immersion device. The holder itself can be adjustable so as to clamp the bioreceptacle between the parts thereof, e.g. via the spring or lever means mentioned previously.

The holder 22 receives a pair of metal plates 25 which rest directly against the outer walls of the bioreceptacle 28 and can be conformed geometrically to them. Along the outer surfaces of these metal plates, there are provided synthetic-resin plates 23 of low thermal conductivity which are engaged by the holder 22 only at the upper end lower ends. Since the holder 22 can be of adjustable size, it can receive plates 23 of different thickness, the thickness of the plates corresponding to the desired temperature gradient to be maintained in the manner described previously.

For the fine control of the freezing process, as in the system of FIG. 1, the surface of the metal plates 25 turned away from the bioreceptacle 28, can be provided with heating coils 24 embedded in silicone rubber while the surface turned toward and contacting the bioreceptacle 28 carries a temperature-sensing element 26 which is connected to the controller 27 operating the heating element 24.

The metal plates 25 serve not only as carriers for the temperature-sensing element 26 and the heating device 24 but also impart a flat predetermined uniform configuration to the synthetic-resin sac containing the biological substances and thus serve to homogenize the heat transfer over the broad surfaces of the bioreceptacle.

Figure 3:
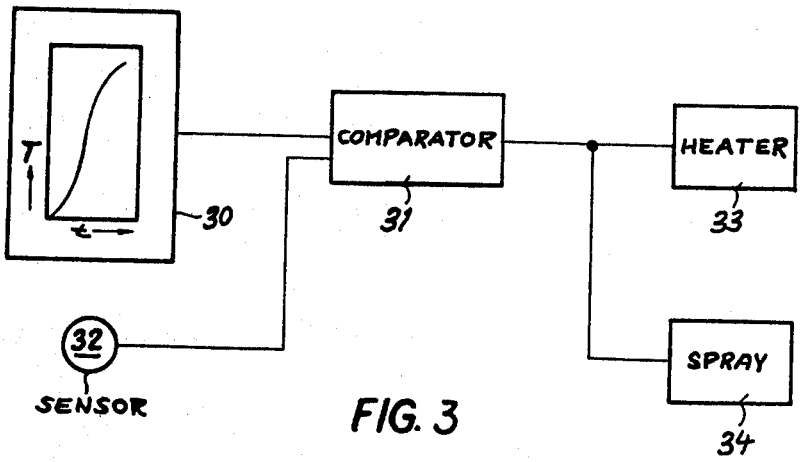
FIG. 3 is a block diagram showing a control system for the purpose of the present invention.

As can be seen from FIG. 3, the control or regulator system 9 or 27 can include a memory 30 in which the temperature-time curve is recorded upon calculation as described above, this memory supplying one input to a comparator 31 whose other input is supplied by a temperature sensor 32 which can represent the sensor 8 or 26 of FIGS. 1 and 2. A different signal from the input of the comparator 31 can be applied to the heater 33, e.g. the electrical heater 7 or 24 of FIGS. 1 and 2, or to the deep-freezing spray control unit 34 which can be the valve 10 of FIG. 1.

Figure 4:
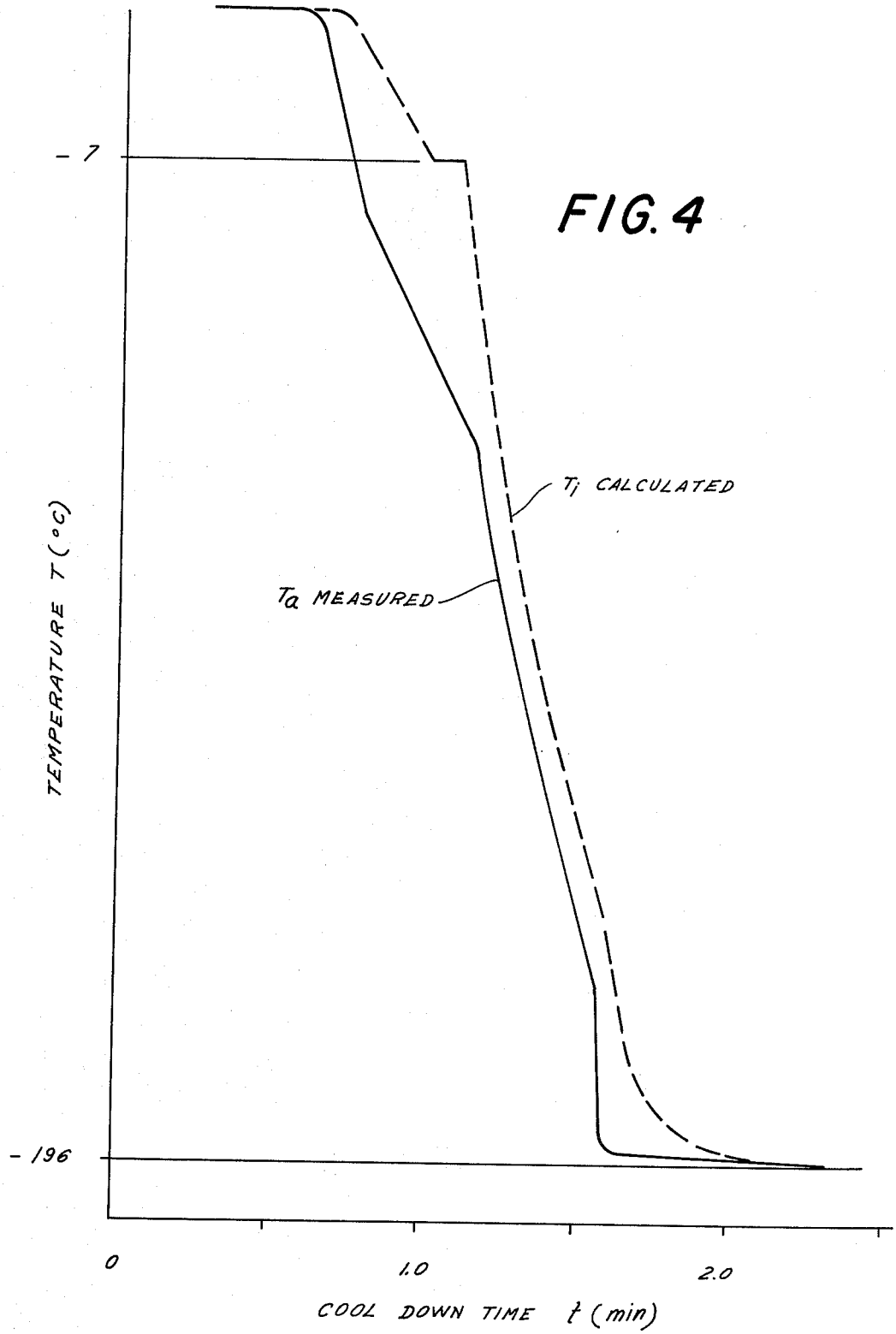
FIG. 4 is a graph of the temperature (ordinate) versus the cool-down time (abscissa) demonstrating the invention.

By way of example, I have shown in FIG. 4 a graph of temperature-time curve as calculated for blood and the corresponding measured values as obtained by a test probe in the interior of the bioreceptacle. The latter is constituted of polyethylene foil.

The formulas for calculating the temperature-time curve are derived from the partial differential equation for the instantaneous heat conduction:

$$\frac{\partial T(x,t)}{\delta t} = a\frac{\partial^2[T(x,t)]}{\delta x^2} \qquad \text{(I)}$$

in which T is the local temperature, $x$ is the position coordinate in the direction of the maximum temperature gradient, $t$ is the time and $a$ is the coefficient of temperature conductivity.

The boundary conditions in the coolant are taken into consideration in the following formula:

$$\lambda_1 \frac{\partial T(x,t)}{\partial x} = \alpha[T(x_o z) - T_o] \qquad \text{(II)}$$

$$x = x_o$$

in which $T_o$ is the cooling temperature, $x_o$ is the outer wall of the sample, $\lambda_1$, is the heat conductivity of the wall and $\alpha$ is the heat transfer coefficient.

The other boundary conditions are obtained from the formula III:

$$\lambda_1 \frac{\partial T(x,t)}{\partial x}\Bigg|_{x = x_{ik}} = \lambda_n \frac{\partial T(x,t)}{\partial x}\Bigg|_{x = x_{ki}} \qquad \text{(III)}$$

$x_{ki} = x_{ik}$ represents the location at which the two media meet.

The migration of the phase boundary in the liquid medium, which corresponds to a migrating heat source, is considered in the following equation:

$$\rho_i \varphi_i \frac{\partial \zeta}{\partial t} = \frac{\partial T(x,t)}{\partial x}\Bigg|_{\zeta - o} = \frac{\partial T(x,t)}{\partial x}\Bigg|_{\zeta + o} \qquad \text{(IV)}$$

whereby medium $i$ merges into medium $k$.

Figure 5:
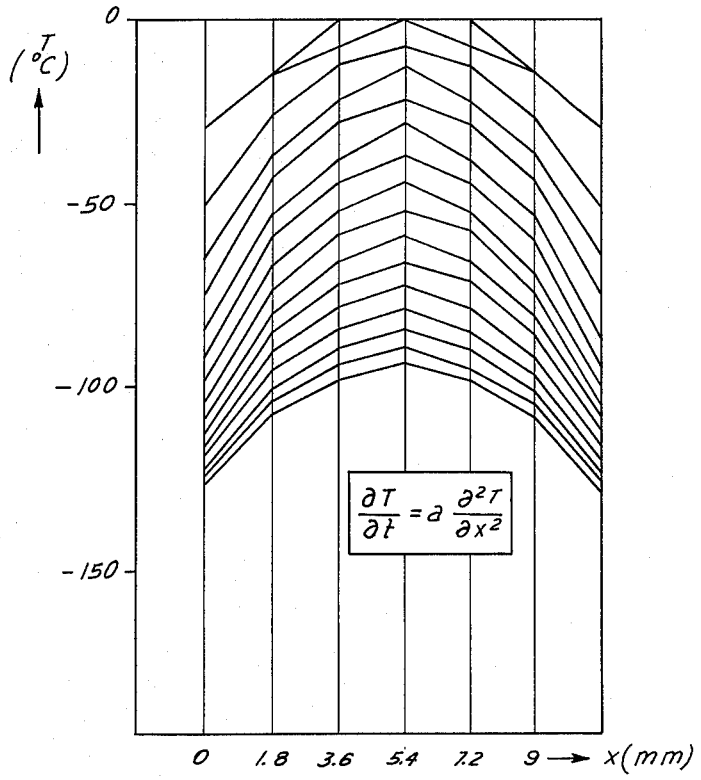
FIG. 5 is a series of graphs in which the variation in temperature of a frozen suspension at a distance within the suspension from the cooling surface (abscissa) is plotted as a function of the applied temperature at the surface of the receptacle (ordinate).

FIG. 5 shows the results obtained with a sample having a total thickness of 10.8 mm in which, for clarity, the distance from the cooled wall has been plotted in an expanded scale (see the $x$ value of the abscissa). The values of $\Delta x$ are thus more sharply drawn. Each curve corresponds to a given time $t$. The biological agent is human blood admixed with 14% by weight of hydroxyethyl startch as a cryogenic protective agent. In order to keep the temperature gradient as low as possible, as is necessary, for example, to protect the leucocyte, the plates of low thermal conductivity are 12 mm thick plates of low pressure polyehtylene. The assembly of receptacle holder, bioreceptacle containing the biological specimen and low thermal conductivity plates is immersed in liquid nitrogen at a temperature of −196° C.

I claim:

1. A process for the deep freezing of biological substances which comprises the steps of:

enclosing the biological substance to be deep frozen in a bioreceptacle; 'determining the temperature-time curve for the outer wall of said bioreceptacle which corresponds to the temperature gradient necessary to freeze all of said biological substance within the receptacle with an effective cell survival rate and subjecting the bioreceptacle to heat exchange with a fluid coolant at a temperature sufficient to deep freeze said biological substance while controlling the temperature applied to the outer surface of said bioreceptacle as a function of time to conform to said temperature-time curve whereby the biological substance within the receptacle is subjected substantially exactly to said temperature gradient.

2. The process defined in claim 1 wherein said bioreceptacle is sprayed with said liquid coolant and the rate at which said liquid coolant is sprayed is controlled in dependence upon the temperature measured at the outer wall of said bioreceptacle.

3. The process defined in claim 1 wherein the bioreceptacle is immersed in the liquid coolant and the temperature at the outer surface of said bioreceptacle is controlled as a function of time by interposing between said bioreceptacle and said liquid coolant a material of low thermal conductivity and of a thickness determined by said temperature-time curve.

4. The process defined in claim 1, further comprising the step of heating the outer surface of said bioreceptacle to maintain the temperature thereof in conformity with said temperature-time curve during the deep freezing.

5. An apparatus for the deep freezing of biological substances contained in a bioreceptacle, said apparatus comprising:

means for subjecting said bioreceptacle to heat exchange with a liquid coolant at a temperature sufficient to deep freeze the biological substance therein; and means for controlling the temperature at an outer surface of said bioreceptacle as a function of time to conform with a calculated temperature-time curve providing a temperature gradient at which said biological substance is deep frozen with an effective cell survival rate.

6. The apparatus defined in claim 5 wherein said means for subjecting said bioreceptacle to heat exchange with said liquid coolant comprises a cooling channel, means for supplying a liquid coolant to said coolant channel and a control member between said supplying means and said coolant channel, said control means including a controller operatively connected to said control member for regulating the supply of the liquid coolant to said cooling channel.

7. The apparatus defined in claim 6 wherein said cooling channel is provided with spray means for spraying said liquid coolant toward said receptacle.

8. The apparatus defined in claim 7, further comprising a holder in said cooling channel for said bioreceptacle, said holder having a temperature-sensing element in contact with an outer surface of said bioreceptacle and operatively connected to said controller.

9. The apparatus defined in claim 8 wherein said holder is formed on a surface opposite said bioreceptacle with heating means controlled by and connected to said controller.

10. The apparatus defined in claim 6 wherein said supplying means includes a container for the liquid coolant and a container for said coolant in gaseous form and at an elevated pressure, said controller including means for interconnecting said containers upon a decrease in the pressure within the container for said liquid coolant.

11. The apparatus defined in claim 5 wherein said bioreceptacle is subjected to heat exchange with said liquid coolant by immersing said bioreceptacle in a bath of said liquid receptacle, said means for controlling the temperature at the outer surface of said bioreceptacle including plates of low thermal conductivity interposed between said coolant and a metal plate in contact with said bioreceptacle and of a thickness selected to maintain a temperature at said outer surface substantially in conformity with said temperature-time curve, and electrical heating means on said metal plates for fine adjustment of the temperature at said outer surface of said bioreceptacle.

* * * * *